US006336596B1

(12) United States Patent
Katzman et al.

(10) Patent No.: US 6,336,596 B1
(45) Date of Patent: Jan. 8, 2002

(54) ELECTRICALLY OPERATED SPRINKLER

(75) Inventors: Oded Katzman; Zohar Katzman, both of Kibbutz Dan (IL)

(73) Assignee: Dan Mamtirim, Kibbutz Dan (IL)

( * ) Notice: Subject to any disclaimer, the term of this patent is extended or adjusted under 35 U.S.C. 154(b) by 0 days.

(21) Appl. No.: 09/381,709

(22) PCT Filed: Mar. 24, 1998

(86) PCT No.: PCT/IL98/00130

§ 371 Date: Feb. 11, 2000

§ 102(e) Date: Feb. 11, 2000

(87) PCT Pub. No.: WO98/42445

PCT Pub. Date: Oct. 1, 1998

(30) Foreign Application Priority Data

Mar. 25, 1997 (IL) ..... 120519

(51) Int. Cl.[7] ..... B05B 15/10; B05B 3/00

(52) U.S. Cl. ..... 239/204; 239/263.1; 239/264

(58) Field of Search ..... 239/200–206, 239/263.1, 264

(56) References Cited

U.S. PATENT DOCUMENTS 3,084,869 A * 4/1963 Hutty et al. ..... 239/203
3,709,435 A * 1/1973 Sheets ..... 239/206
4,809,910 A * 3/1989 Meyer ..... 239/201
5,351,885 A * 10/1994 Manabe ..... 239/263.1

* cited by examiner

*Primary Examiner*—David A. Scherbel
(74) *Attorney, Agent, or Firm*—Needle & Rosenberg, P.C.

(57) ABSTRACT

A rotary irrigation sprinkler head having a water inlet and a water outlet and a main rotary part. The main rotary part of said sprinkler head is provided with a gear and a plurality of toothed wheels forming a reduction gear, a first low voltage electric motor is provided connected to said reduction gear, the activation of said electric motor would revolve the sprinkler, and a second low voltage electric motor is provided connected to the outlet nozzle of said sprinkler adapted to control the angle of said outlet nozzle.

8 Claims, 6 Drawing Sheets

ELECTRICALLY OPERATED SPRINKLER

This application claims the benefit of International Application No. PCT/IL98/00130, filed Mar. 24, 1998, which claims benefit of IL Serial No. 120519, filed Mar. 25, 1997, which status is pending.

FIELD OF INVENTION

The present invention relates to a rotary sprinkler and more particularly to electrically operated sprinklers. The sprinklers, according to the invention, could be for irrigating a full circular area or part thereof.

There are known a large number of rotary sprinklers of all kinds of construction, sizes, etc. There is also known as what is described as "pop-up" rotary sprinklers which are housed in a housing unit buried in the ground adopted to pop-up when the water supply is turned on.

The present invention relates to all kinds of sprinklers, however it is extremely useful for "pop-up" sprinklers, without excluding use of the invention with conventional rotary sprinklers.

As is well known in the art, the rotary movement of the rotary sprinkler is obtained by what is known as water motors, namely, the water flow rotates the sprinkler head. It is well known that in order to achieve the rotary movement, some of the water energy is being used for obtaining the rotary movement of the sprinkler. Due to the above there is loss of pressure, the efficiency of the sprinkler is affected, i.e., the outjetting water stream is less effective, the flow rate is lesser, the range is shorter and uniformity of dispersion is inferior.

OBJECTS OF THE INVENTION

It is object of the present invention to obtain rotary movement of rotary sprinklers by electric power rather than water power so that the full water pressure is being used for irrigation and not for activating the rotary movement. By using the full water pressure, better irrigation and better performance of the sprinkler is achieved.

Consequently by using an electric motor, further benefits are achieved, such as speeding or slowing the rotary movement of the sprinkler, changing directions, full control over the out-jetting water stream and stopping the rotational movement at any given point, if so required.

SUMMARY OF INVENTION

According to the invention there is provided a rotary irrigation sprinkler head, a water inlet and a water outlet. The main rotary part is provided with a gear and a plurality of toothed wheels forming a reduction gear to which a low voltage electric motor is connected. The said electric motor is connected to an electrical power source.

In the preferred embodiment a second electric motor is connected to the water outlet nozzle to enable the control of the angle the water jet.

By employing two such motors, and controlling each one independently it enables to maintain uniform distribution of water regardless of the shape and size of irrigated area.

SHORT DESCRIPTION OF DRAWINGS

The invention will now be described with reference to the annexed drawings in which the invention is implemented by way of example in a pop-up sprinkler.

Figure 1:
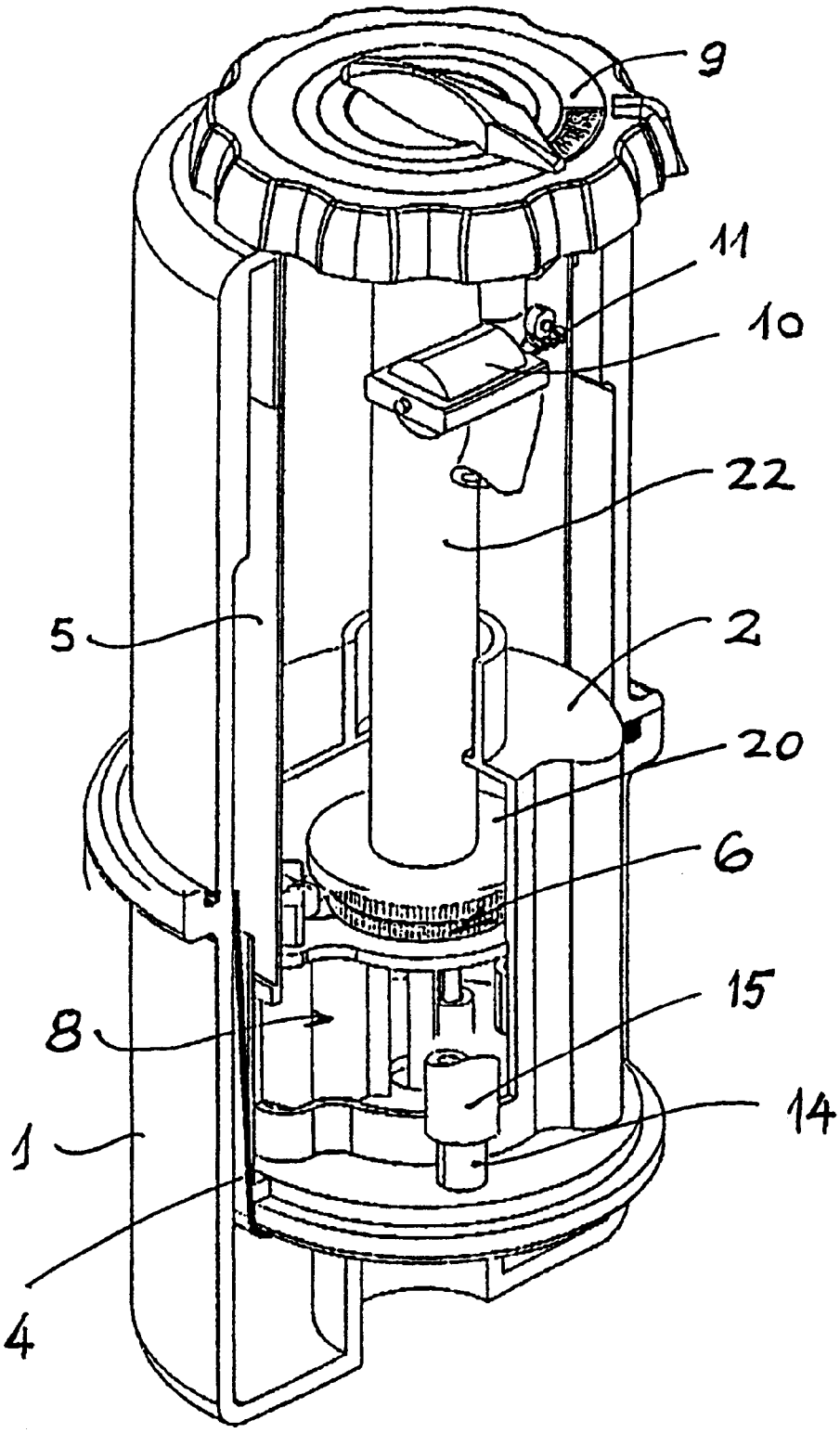

FIG. 1 is a perspective illustration of a sprinkler according to the invention partly in section.

Figure 1A:
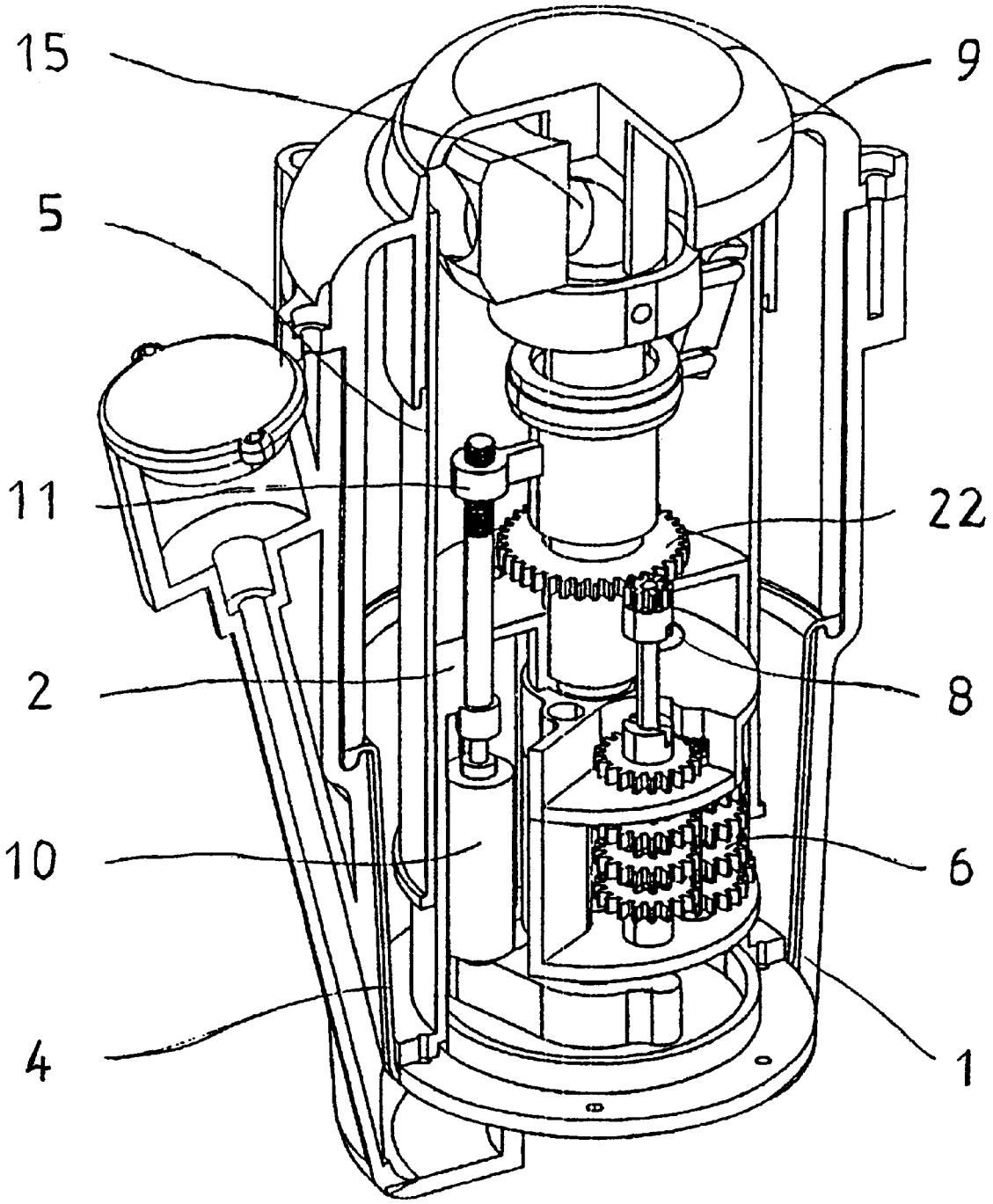

FIG. 1*a* is likewise a perspective illustration of an embodiment of a sprinkler.

Figure 2:
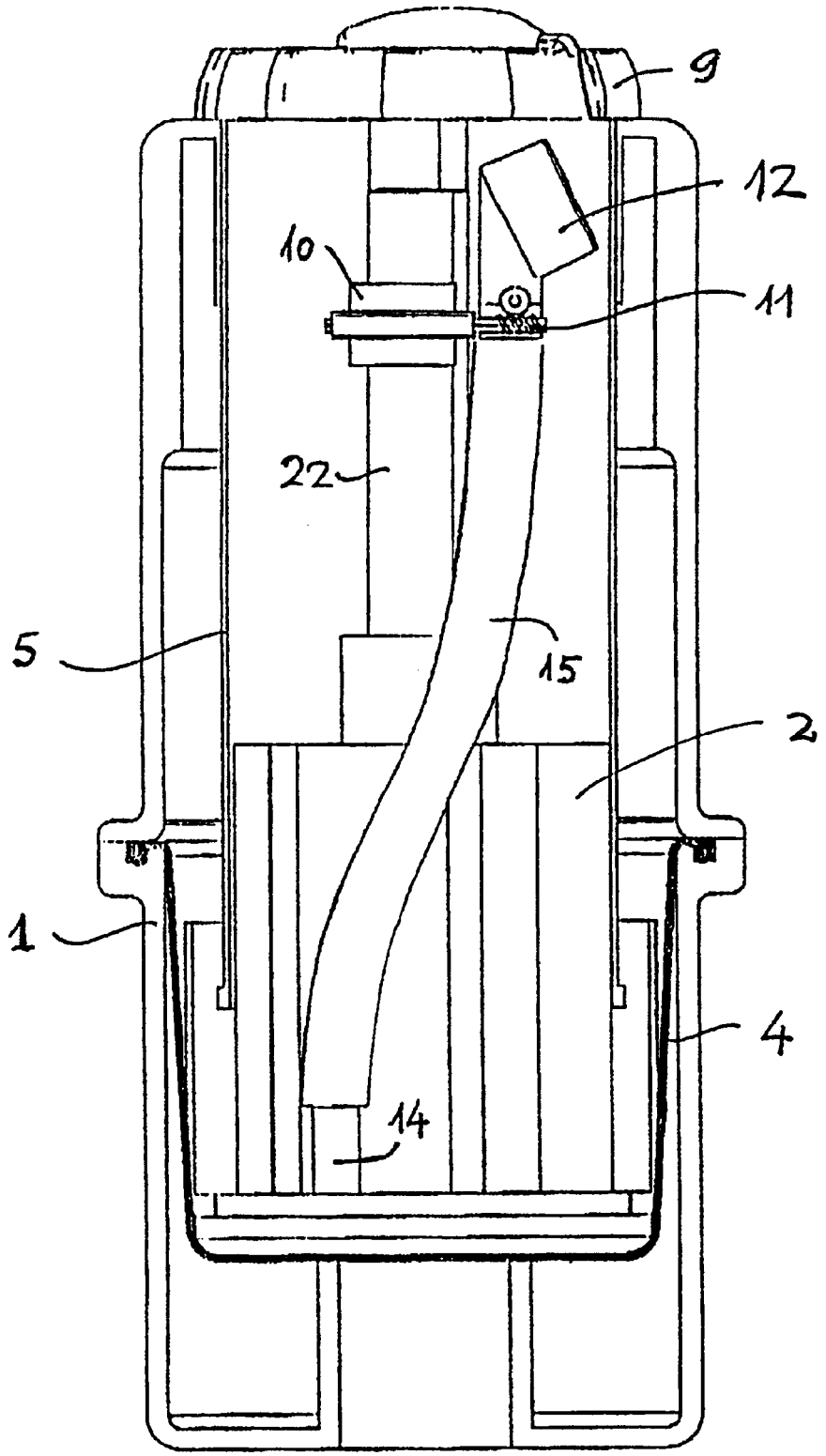

FIG. 2 is a cross section of a sprinkler according to the invention partly in section.

Figure 2A:
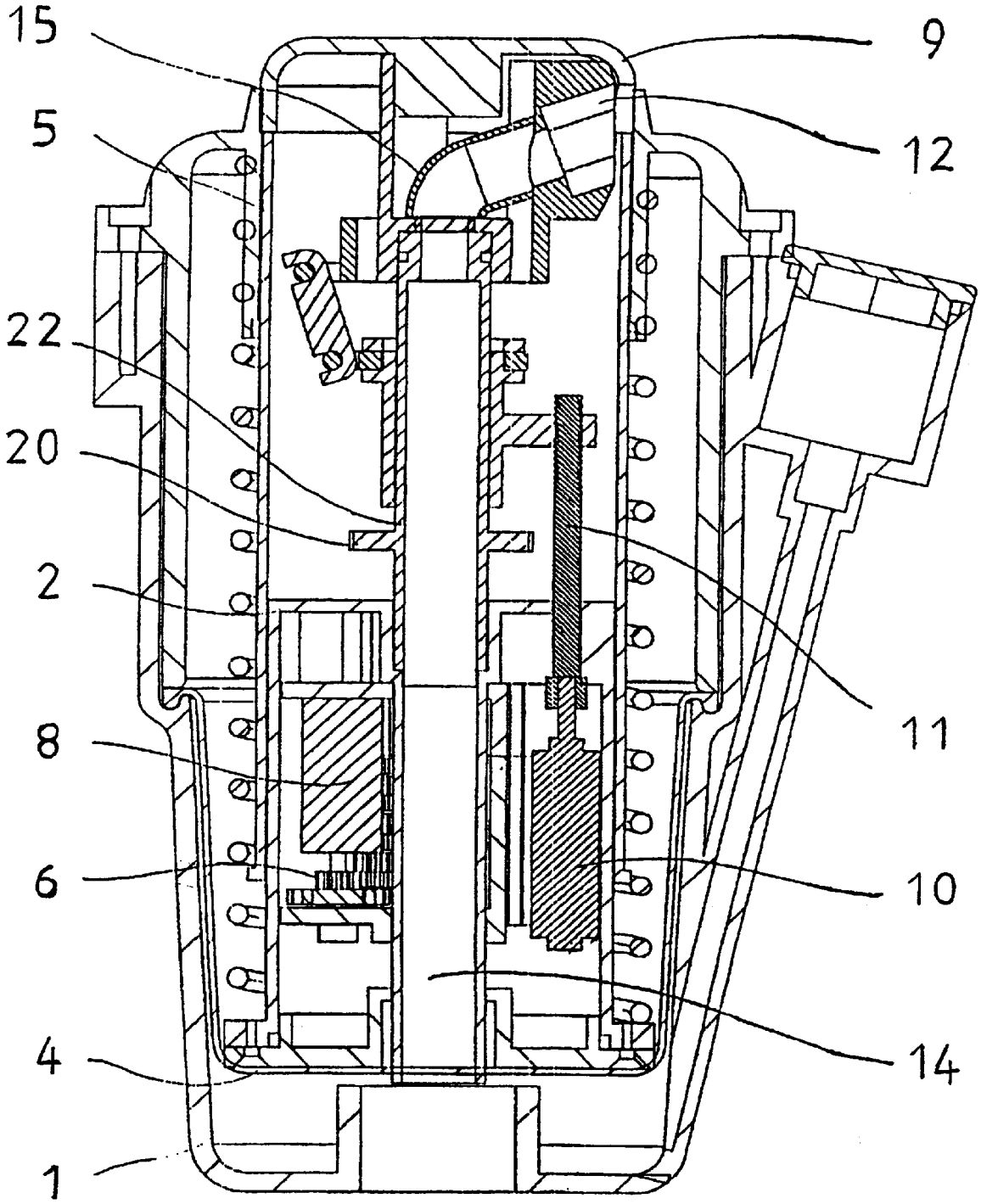

FIG. 2*a* is a cross section of the embodiment of FIG. 1*a*.

Figure 3:
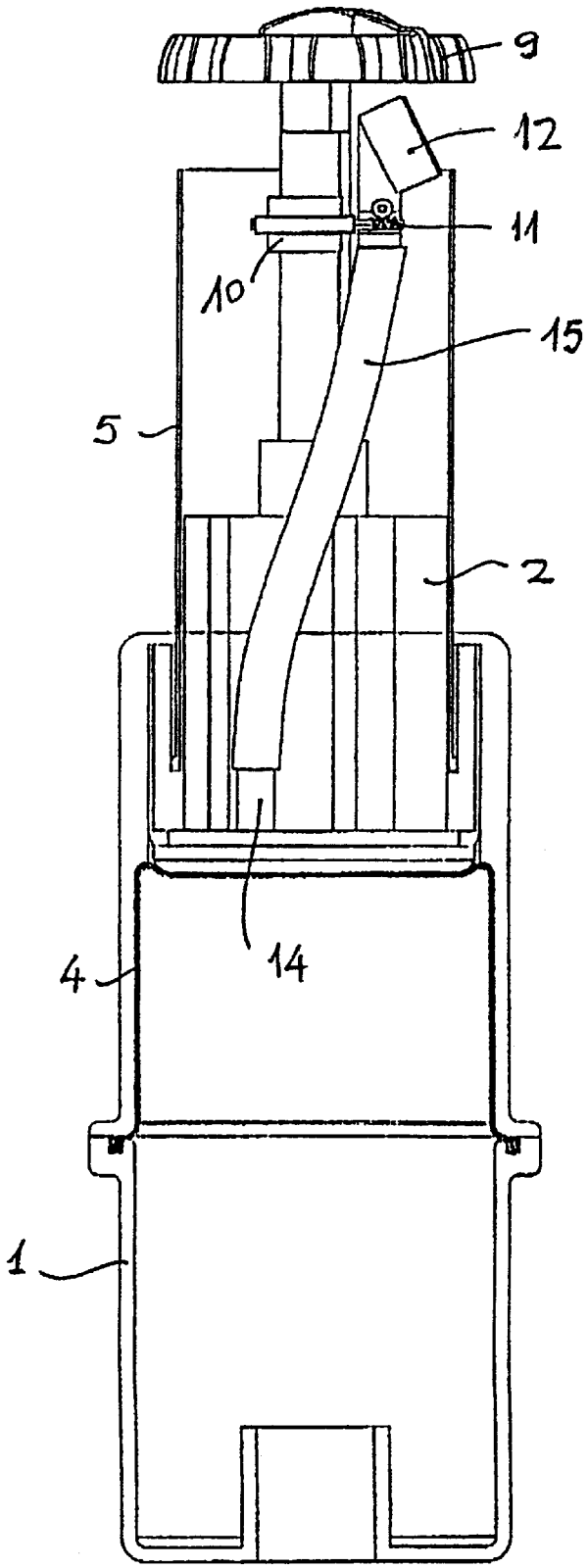

FIG. 3 illustrates the sprinkler in the pop-out position showing the rolling membrane and its attachment.

Figure 3A:
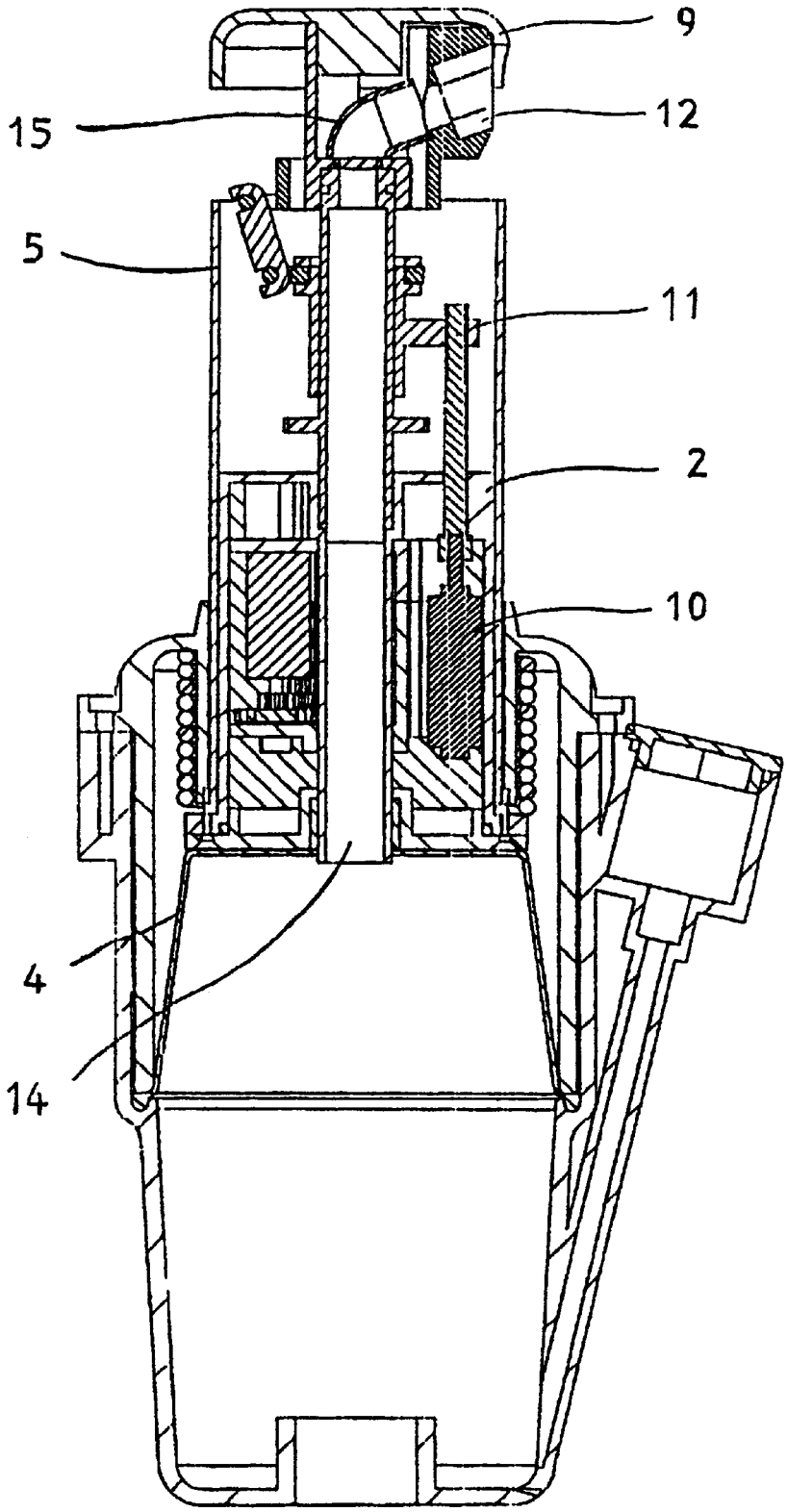

FIG. 3*a* illustrates the pop-out position of the embodiment seen in FIG. 1*a*.

It should be noted that though the figures depict a pop-up sprinkler, nevertheless, as mentioned above the same mechanism could be applied to a non pop-up sprinkler.

DESCRIPTION OF PREFERRED EMBODIMENT

Turning first to FIG. 1 which is a perspective illustration partly in section of the sprinkler according to the invention.

Within housing 1 there is mounted a second housing 2, surrounded by sleeve 5 intermediate the two housings, there is provided a flexible membrane 4 forming a waterproof separation between the two housings. Alternatively a lip seal (not seen) is mounted. Within housing 2 there is provided a reduction gear mechanism 6 and an electric motor 8. Underneath cover 9 of the sprinkler or within the sprinklers housing there is provided a second electric motor 10 which is connected by connecting mechanism 11 to outlet nozzle 12. Outlet nozzle 12 is connected to inlet 14 by means of flexible hose 15, the water may however pass through central rotating part 22.

Turning now to FIG. 3. which illustrates the sprinkler in it's popped-out position namely housing 2 with sleeve 5 being pushed out of housing 1 by the water pressure acting on membrane 4 or on housing 2. The main tooth wheel 20 is fixedly connected to the rotational part 22 of the sprinkler. Electric motor 8 is connected to reduction gear 6 which is in mesh with tooth wheel 20. Consequently the operation of motor 8 would result the rotation of rotational part 22 and nozzle 12.

The electric motor or motors could be connected to any external electric power source such as the main electric power supply cables or to built in batteries or to a solar energy power source or a power generation dynamo, etc.

Once the power is turned on the rotation of the sprinkler will start. As outlet nozzle 12 is also connected to an electric motor 10 it would be possible to control the angle of the outlet nozzle 12, consequently there would be provided full control over the distance of the out-jetting water stream.

It is quite apparent that due to the possibility of separate controlling of the pivoting of the sprinkler and the angle of the out-jetting water any uneven shape of area could be irrigated in a uniform manner.

It is further apparent from the above description that by using a flexible hose which connects the inlet and outlet of the sprinkler the water does not pass any mechanical arrangement of the sprinkler.

What is claimed is:

1. A rotary irrigation sprinkler head having a water inlet and a water outlet, a main rotary part of said sprinkler head is provided with a gear and a plurality of toothed wheels forming a reduction gear, a first low voltage electric motor is provided connected to said reduction gear, the activation of said electric motor would revolve the sprinkler, a second low voltage electric motor is provided connected to the outlet nozzle of said sprinkler adapted to control the angle of said outlet nozzle.

2. A rotary irrigation sprinkler head as claimed in claim 1, wherein said water inlet and said water outlet are connected with a flexible hose.

3. A rotary irrigation sprinkler head as claimed in claim 1, wherein water may pass through the main rotary part.

4. A rotary irrigation sprinkler head as claimed in claim 1, wherein the sprinkler head further comprises two housings placed one within the other and a flexible membrane is provided intermediate said two housings forming a waterproof separation between said housings.

5. A rotary irrigation sprinkler head as claimed in claim 1, wherein the sprinkler head further comprises two housings placed one within the other and a ring lip seal is mounted intermediate said two housings.

6. A rotary irrigation sprinkler head as claimed in claim 1, wherein said electric motors are connected to an external electric power source or solar energy.

7. A rotary irrigation sprinkler head as claimed in claim 1, wherein said electric motors are connected to a built in power source such as batteries.

8. A rotary irrigation sprinkler head of claim 1, wherein said electric motors are synchronized by a camroler.

* * * * *